United States Patent [19]

Suwa et al.

[11] Patent Number: 4,928,605

[45] Date of Patent: May 29, 1990

[54] OXYGEN HEATER, HOT OXYGEN LANCE HAVING AN OXYGEN HEATER AND PULVERIZED SOLID FUEL BURNER

[75] Inventors: Toshio Suwa, Kawasaki; Nobuaki Kobayashi; Takashi Hirano, both of Tokyo, all of Japan

[73] Assignee: Nippon Sanso Kabushiki Kaisha, Tokyo, Japan

[21] Appl. No.: 86,734

[22] PCT Filed: Nov. 14, 1986

[86] PCT No.: PCT/JP86/00582

§ 371 Date: Jul. 9, 1987

§ 102(e) Date: Jul. 9, 1987

[87] PCT Pub. No.: WO87/03065

PCT Pub. Date: May 21, 1987

[30] Foreign Application Priority Data

Nov. 15, 1985 [JP] Japan ..... 60-256351
Nov. 15, 1985 [JP] Japan ..... 60-256352
Nov. 15, 1985 [JP] Japan ..... 60-256353

[51] Int. Cl.[5] ..... F23C 1/10; F23D 1/00

[52] U.S. Cl. ..... 110/261; 110/263; 110/347; 431/160; 431/11; 431/237; 431/242; 431/243; 431/247

[58] Field of Search ..... 431/236, 237, 242, 284, 431/285, 278, 8, 9, 10, 11, 115, 160, 247, 243, 232; 110/261, 265, 264, 347

[56] References Cited

U.S. PATENT DOCUMENTS

| | | | |
|---|---|---|---|
| 1,163,650 | 12/1915 | Fogler | 431/160 X |
| 1,302,914 | 5/1919 | Goreau | 431/285 |
| 1,614,359 | 11/1927 | Gaston | 431/236 |
| 1,865,056 | 6/1932 | Goldsborough | 431/285 X |
| 2,219,917 | 10/1940 | Crosiar | 431/236 X |
| 2,702,743 | 2/1955 | Totzek | 110/264 X |
| 2,851,093 | 9/1958 | Zinele et al. | 431/285 |
| 2,932,347 | 4/1960 | Jaeger | 431/285 X |
| 2,986,206 | 5/1961 | Boelsma | 431/9 X |
| 3,030,773 | 4/1962 | Johnson | 431/9 X |
| 3,182,711 | 5/1965 | Robb | 431/353 X |
| 3,529,915 | 9/1970 | Tsuji et al. | 431/284 |
| 3,661,561 | 5/1972 | Frey, Jr. et al. | 75/68 A X |
| 3,993,449 | 11/1976 | Childs | 431/9 X |
| 4,313,721 | 2/1982 | Henriques | 431/351 X |
| 4,531,904 | 7/1985 | Sato et al. | 431/242 X |
| 4,544,350 | 10/1985 | Ware et al. | 431/285 |
| 4,566,393 | 1/1986 | Connell et al. | 40/262 X |

FOREIGN PATENT DOCUMENTS

| | | | |
|---|---|---|---|
| 1501909 | 1/1970 | Fed. Rep. of Germany | 431/158 |
| 2455110 | 5/1976 | Fed. Rep. of Germany | 431/284 |
| 1341357 | 12/1962 | France | 431/236 |
| 51-35165 | 9/1976 | Japan . | |
| 52-36277 | 8/1977 | Japan . | |
| 57-56061 | 12/1982 | Japan . | |
| 58-173369 | 4/1983 | Japan . | |
| 60-105911 | 7/1985 | Japan . | |

*Primary Examiner*—Carl D. Price
*Attorney, Agent, or Firm*—Kane, Dalsimer, Sullivan, Kurucz, Levy, Eisele and Richard

[57] ABSTRACT

There is disclosed an oxygen heater, which uses a part of supplied oxygen as auxiliary combustion oxygen, a hot oxygen lance and a pulverized solid fuel burner, both having oxygen heaters. The oxygen heater (1) has a combustion chamber (4) for both mixing and burning fuel with the part of the supplied oxygen. An oxygen-jetting opening (8) is disposed around the combustion chamber. The oxygen jetted out of the opening forms a gas curtain between an internal wall (2) and a flame (10) produced in the combustion chamber, and is heated by the flame. Both the oxygen lance and the burner includes the above-mentioned oxygen heater.

12 Claims, 6 Drawing Sheets

OXYGEN HEATER, HOT OXYGEN LANCE HAVING AN OXYGEN HEATER AND PULVERIZED SOLID FUEL BURNER

TECHNICAL FIELD

This invention relates to an oxygen heater for producing hot oxygen which is required in the refining of ferrous and nonferrous metals, such as the direct reducing smelting of aluminum.

This invention also relates to a lance for supplying hot oxygen to a zone for the refining of ferrous and nonferrous metals such as, in particular, the reduction reduction zone of a direct reducing furnace.

This invention further relates to a pulverized solid fuel burner used in an electric furnace for melting steel scrap, aluminum, copper and the like.

BACKGROUND ART

Recently, there have been developed, methods of refining aluminum in a blast furnace. In the conventional methods, such as disclosed in U.S. Pat. No. 3,661,561, oxygen preheated to approximately 1,000° C. is blown into a blast furnace through a plurality of tuyeres of the furnace. In these processes, in order for the refining of aluminum in the blast furnace to be successful, it has been important subject how efficiently the preheated oxygen was generated and supplied to the furnace. One of the prior heater devices used in an experiment produced the hot oxygen by effecting the heat exchange between oxygen of room temperature and a fluid generated by another heat source. However, in the experiment using this particular heater device, the amount of the produced hot oxygen was several tens of thousand $Nm^3/h$. Consequently, it is not economical to apply the above-mentioned way of preheating oxygen to the preheating process when there is no utilizable heat source and when a specific heat source must be newly prepared.

Also, the use of hot oxygen in the refining process of steel or zinc, has been suggested. It is desired in this case to provide a device that can produce and supply a great amount of hot oxygen safely and efficiently.

In the refining of iron or aluminum, air or oxygen-enriched air is supplied to a furnace through the tuyere or the lance of the furnace after it is heated up to a high temperature. An example of the heater which is applicable to this refining is shown in Japanese Published Unexamined Patent Application No. 59-501278. This heater, i.e., a burner which also serves as a lance is used for heating metal products in a fusion furnace. Oxygen is discharged in a jet from the nozzle of the burner and fuel is supplied from the conduit concentrically surrounding the nozzle. The supplied fuel is then jetted into the discharged oxygen and is burned with the oxygen, which produces hot oxygen including combustion gas. Depending on the purpose, the oxygen content of the combustion gas is controlled and the heater is used either as a burner or as a lance for hot oxygen containing combustion gas.

However, there arises a problem of the temperature of the peripheral portion of the burner rising severely since the construction of the burner is such that fuel supplied from the nozzle-surrounding conduit is jetted into and mixed with the oxygen flow and is burned within the burner so that the hot combustion gas including oxygen is produced.

These days, there are used, burners which utilize pulverized coal as their main fuel for the purpose of melting steel scrap, aluminum, copper and the like. These burners must produce flames having stable temperatures of not less than approximately 2,000° C. so that the burners have the required melting capacity. However, the combustion rate of pulverized coal is extremely slow in comparison with that of a liquid fuel such as fuel oil or a gaseous fuel such as $CH_4$, $C_3H_8$ and the like. Also, the flame temperature of pulverized coal is lower than that of the liquid or gaseous fuel. It is not easy to produce a stable flame by the monofuel combustion of pulverized coal. The flame due to the monofuel combustion is unstable and sometimes extinguished when the temperature of the atmosphere in the vicinity of the burner in a furnace is low, causing its radiant heat to be reduced. For these reasons, there have been used, burners which utilize a gaseous or liquid fuel such as LPG, natural gas, fuel oil and the like, and the pulverized coal has been used as the fuel of combination burners which also use a liquid or gaseous fuel along with the pulverized coal. However, the combination burners are not economical enough since the mixture ratio of liquid or gaseous fuel must be increased, that is, the consumption of the pulverized coal must be decreased in order for the combination burners to produce flames of high temperature.

FIG. 1 shows an instance of the conventional combination burner which uses pulverized coal mixed with a liquid fuel. This burner has six cylinders coaxially disposed to each other, wherein the innermost cylinder is a conduit 231 for supplying liquid fuel, the cylinder surrounding the conduit 231 is a conduit 232 for supplying auxiliary combustion gas for assisting the combustion of the liquid fuel, the cylinder surrounding the conduit 232 is a conduit 233 for supplying pulverized coal, the cylinder surrounding the conduit 233 is a conduit 234 for supplying auxiliary combustion gas for assisting the combustion of the pulverized coal, and the last cylinder surrounding the conduit 234 is a jacket 235 for circulating cooling water. The liquid fuel-supplying conduit 231 is provided at its front end with a nozzle 236 for discharging the liquid fuel supplied through the conduit 231 in a jet. Also, the auxiliary combustion gas-supplying conduit 232 is provided at its front end with a ring 237 which forms the nozzle for discharging the auxiliary combustion gas in a jet. The auxiliary combustion gas is jetted from the annular opening 238 defined by both the outer periphery of the nozzle 236 and the ring 237, and is mixed with the liquid fuel to produce a primary flame. Reference numeral 239 denotes a cylinder which defines a main combustion chamber 240 in cooperation with the liquid fuel nozzle 236, the front end of the auxiliary combustion gas-supplying conduit 232 and the front end of the pulverized coal-supplying conduit 233. The rear end of the main combustion chamber 240 is in fluid communication with an outlet 241 of the pulverized coal-supplying conduit 233. Around the outlet 241, an outlet 242 for jetting a part of auxiliary combustion gas is open and is in communication with the rear end of the main combustion chamber 240. The pulverized coal discharged from the outlet 241 is mixed with the auxiliary combustion gas discharged from the outlet 242 and is burned by the assistance of the primary flame by the liquid fuel, producing a secondary flame. In front of the combustion chamber 240, a sub-combustion chamber 243 is defined by the inner face of the auxiliary combustion gas-supplying conduit 234 and the front face of main combustion chamber 240. The remainder of the auxiliary combustion gas is jetted into the sub-combustion chamber 243 through the space between the cylinder 239 and the conduit 234, and surrounds the primary and secondary flames to achieve a perfect combustion. In short, in the conventional burners, the flame produced by the liquid fuel and the flame produced by the pulverized coal are combined and form a unitary flame.

As has been described, although it has been planned and tested the blowing of hot oxygen into smelting furnaces upon refining ferrous and nonferrous metals, there has been no oxygen heater, so far, which can efficiently heat an extremely large quantity of oxygen without severely lowering the purity of the oxygen and which is concerned about the safety and durability of itself during the heating process.

Also, the conventional burner uses an unnecessarily large amount of fuel since the hot combustion gas in the vicinity of the burner is cooled by the cooling water circulating in the jacket of the burner, increasing the heat loss. As a result, there arises a problem of the oxygen content of the combustion gas being decreased. That is, the decrease of the oxygen content is not desirable upon the refining of ferrous and nonferrous metals such as, in particular, the fused reduction of aluminum.

Furthermore, there has existed no monofuel combustion burner, for use in a furnace such as an electric furnace for steel scrap, fusion furnace for aluminum and a reverberatory furnace for copper, which is capable of producing a stable flame of high temperature and has a excellent fusing ability even if it is used at regions in the furnaces where the temperature of the atmosphere in the vicinity of burner is relatively low.

The present invention is proposed regarding the above-mentioned situation. An object of the present invention is to provide an oxygen heater which is capable of heating a large quantity of oxygen efficiently without severely lowering the purity of oxygen and which is concerned about the safety and durability of itself during the heating process.

Another object of the present invention is to provide an oxygen lance having an oxygen heater which has a compact construction and reduces the heat loss such as, in particular, the heat loss in the combustion gas-producing region, thereby producing hot gas having a high oxygen content.

A further object of the present invention is to provide a pulverized solid fuel burner in which the pulverized solid fuel is used as the main fuel and gaseous or liquid fuel is used merely for preheating auxiliary combustion gas.

DISCLOSURE OF THE INVENTION

With these objects in view, one aspect of the present invention is directed to an oxygen heater having a combustion chamber and an oxygen-jetting opening formed in the wall defining the combustion chamber. In the combustion chamber, fuel is mixed with oxygen and burned with the oxygen. The opening is disposed around the combustion chamber so that the oxygen jetted out of the opening forms a gas curtain between the internal wall and the flame produced in the combustion chamber. In this oxygen heater, a part of the supplied oxygen is used as an auxiliary combustion gas, whereby the remainder of the supplied oxygen is heated up.

The oxygen-jetting opening may comprise a plurality of nozzles or one or more slits. The opening may be arranged so that the oxygen jetted out of the opening forms a multilayer of gas curtains Also, in this case, the opening may be arranged so that the flow rate of an inner gas curtain is larger than that of an outer gas curtain.

In case that the internal wall is made of a metal, the internal wall may be provided at its outer face with a heat-insulating layer and/or a cooling jacket.

The aforementioned fuel may be gaseous or liquid fuel. The fuel-jetting opening must be the proper one needed for the type of fuel used for the heater.

The oxygen used for the heater is usual industrial oxygen having a purity of 99.8%. Naturally, oxygen produced by a PSA, having a purity of 90%, is also applicable to the heater.

The operation of the oxygen heater will now be described.

A part of the supplied oxygen together with the fuel, is introduced into the combustion chamber. Then, the mixture of the fuel and the oxygen is burned, whereby a stable flame is blown out of the opening of the combustion chamber. Most of the remainder of the oxygen, which is to be heated up, is jetted out of the nozzles or slits for forming the oxygen curtain surrounding the produced flame. The oxygen curtain prevents the internal wall both from being local overheated and from unnecessarily releasing heat, thereby protecting both the internal wall made of metal and the internal wall made of refractory material.

Also, the curtain oxygen cools not only a chamber-forming member which defines the oxygen-jetting opening but also the combustion chamber. The curtain oxygen is mixed in front of the combustion chamber with the combustion gas that is produced in the combustion chamber to be oxygen-containing hot gas, and the hot gas is supplied to the place where it is demanded. The maximum temperature of the hot gas at the outlet of the heater is equal to the temperature of a perfect mixture of the combustion gas and oxygen having room temperature. When the temperature of the hot gas at the outlet is approximately 700° to 1,000° C., there is no need for the cooling jacket surrounding the internal metal wall since the oxygen curtain protect this internal metal wall. When the temperature of the hot gas increases to 1,200° C. and over, cooling means such as a cooling jacket for cooling the metal internal wall must be provided.

The preferable cooling means are, to arrange a multilayer of oxygen curtains This results in a stable streamline flow of curtain oxygen protecting the internal wall more effectively. In this case, by making the flow rate of an inner curtain oxygen higher than that of the outer curtain oxygen, the outer oxygen curtain adjoined to the internal wall is retained more successfully and protects the the internal wall completely.

Although the oxygen heater according to the present invention is proposed as a heater for supplying a great amount of hot oxygen for smelting, its use is also naturally applicable to other objects which require hot oxygen.

According to the oxygen heater of the present invention, a great amount of hot oxygen for refining can be produced efficiently by using little fuel for heat source. Also, the heater of the present invention prevents the internal wall from being local overheated, thereby enhancing the safety and durability of the heater itself both when the internal wall is made of metal and when the internal wall is made of refractory. Furthermore, this total apparatus is capable of being compact.

Since, in this heater, heat loss from the internal wall to outside the heater is minimized, the amount of the fuel used for heating oxygen is reduced, whereby there is produced, hot gas having a high oxygen content even though this hot gas has a relatively high temperature.

Another aspect of the present invention is directed to a hot oxygen lance having an outer cylinder in which an oxygen heater, having a combustion chamber and a oxygen nozzle, is disposed. In the combustion chamber, fuel is mixed with oxygen and is burned with the oxygen. The oxygen nozzle directs the oxygen passing therethrough to form an oxygen curtain surrounding the combustion chamber. A heat-insulating layer and/or a cooling jacket may be disposed around a part of, or the entire, outer cylinder. Also, the lance may have a center pipe around which a plurality of the combustion chambers, in which the fuel is mixed and burned with oxygen, are provided. The oxygen nozzle may be arranged so that a multilayer of oxygen curtains coaxial to one another are formed. In this case, it is preferred to arrange the oxygen nozzle so that the flow rate of an outer oxygen curtain is higher than that of an inner oxygen curtain.

It is also preferred that the fuel used for the lance is gaseous or liquid fuel.

Furthermore, the outer cylinder may have a branch cylinder in which the oxygen heater is disposed. The oxygen nozzle for forming the oxygen curtain may be a plurality of small holes or a slit.

The operation of this oxygen lance is as follows: In the oxygen lance according to the present invention, a part of the supplied oxygen is introduced into the combustion chamber together with the gaseous or liquid fuel, and is mixed with the fuel. The fuel is, then, burned with the oxygen and produces a stable flame which blows out from the front opening of the combustion chamber. The remainder of the oxygen, that is, most of the supplied oxygen that is to be heated up is blown out of the small holes or the slit along the inner surface of the outer cylinder, resulting in the formation of the oxygen curtain. The oxygen curtain prevents the outer cylinder from local overheating and reduces the heat radiation from the outer cylinder. In other words, by making oxygen of room temperature flow between the flame and the outer cylinder, the outer cylinder is protected from the heat and the heat loss from the outer cylinder is reduced and fuel consumption is lowered. Therefore, oxygen-containing gas having a high oxygen content and a high temperature is produced. This oxygen curtain also cools the oxygen heater (that is, a burner nozzle) which constitutes the combustion chamber. Furthermore, the oxygen lance may be provided at its center position with a center pipe either for supplying pulverized material or for observing the inside of a furnace. A plurality of the combustion chambers may be disposed circumferentially around the center pipe. In this case, the oxygen curtain should be formed so as to enclose each of the combustion chambers, whereby both the center pipe and the outer cylinder are prevented from being overheated and the heat radiation from both the center pipe and the outer cylinder is reduced. Consequently, the fuel consumption of the lance is lowered and the oxygen-containing gas having a high temperature and a high oxygen content is produced.

The combustion gas produced in the combustion chamber is mixed with the curtain oxygen in front of the combustion chamber and is jetted out of the front opening of the outer cylinder Thus, the maximum temperature of the mixed hot gas in contact with the outer cylinder is equal to the temperature of complete mixture of the combustion gas and oxygen at room temperature. When the temperature of the hot gas jetted out of the front opening of the lance is approximately 700° to 1,000° C., the cooling jacket as means for protecting the outer cylinder is not necessary since the oxygen curtain is capable of cooling the outer cylinder efficiently. However, when the temperature of the produced hot gas exceeds 1,200° C., the cooling jacket and the like is necessary for protecting the metal outer cylinder It is preferred to arrange the oxygen curtains in multilayer in order to make the streamline flow of the oxygen stable, causing the outer cylinder to be protected effectively. By increasing the flow rate of an inner curtain oxygen higher than that of an outer curtain oxygen, the outer oxygen curtain is retained stably, whereby the outer cylinder is both protected from heat and prevented from releasing heat almost perfectly. In the same and almost perfect manner, the center pipe is both protected from heat and prevented from releasing heat in case of the lance having the center pipe.

In the hot oxygen lance of the present invention, gaseous or liquid fuel and auxiliary combustion oxygen are introduced into the combustion chamber and are burned to produce a flame. The combustion gas due to the flame and oxygen is mixed so that oxygen-containing hot gas is produced. Since the lance has an oxygen heater in which is included an oxygen nozzle for forming oxygen curtain which encloses the combustion chamber, it is possible to protect the outer cylinder and to reduce the heat loss from the outer cylinder to a minimal level.

In case that the lance is provided at its center position either with a pulverized material-supplying conduit or with a conduit for observation, a plurality of the combustion chambers are circumferentially disposed around the center pipe so that there are produced oxygen curtains enclosing the combustion chambers, whereby both the outer cylinder and the center pipe are protected and the heat loss is decreased to a minimal level. Consequently, with a small amount of fuel capable of raising the temperature of oxygen, hot combustion gas having a high oxygen content can be produced. Also, when the temperature of the hot gas blown out of the jetting opening of the lance is approximately 700° to 1,000° C., means for cooling the outer cylinder, such as the cooling jacket can be omitted.

Still another aspect of the present invention is directed to a pulverized solid fuel burner having a burner body and an auxiliary combustion gas heater. The auxiliary combustion gas heater produces hot auxiliary combustion gas by mixing and burning gaseous or liquid fuel with a part of the supplied auxiliary combustion gas and, by mixing the combustion gas which results from the combustion of the fuel with the rest of the auxiliary combustion gas which is to be used for burning pulverized solid fuel. The pulverized solid fuel may be preheated due to the heat transfer from the hot auxiliary combustion gas, and then, may be mixed and burned with the hot auxiliary combustion gas. Furthermore, the burner may have a main combustion chamber in which the pulverized solid fuel is both mixed and burned with the hot auxiliary combustion gas. The auxiliary combustion gas may comprise oxygen, oxygen-enriched air or air. Also, heat-insulating layers may be disposed on that portion of the burner body where the auxiliary combustion gas heater is attached and on that portion of the burner body which the hot auxiliary combustion gas is brought into contact with. The cooling jacket through which cooling water circulates may be circumferentially provided on the outer surface of the burner body.

The operation of the burner according to the present invention is described as follows: In the auxiliary combustion gas heater, gaseous fuel such as propane and methane, or liquid fuel such as kerosine and heavy oil is burned with auxiliary combustion gas, whereby the hot combustion gas is produced. This hot combustion gas is mixed with auxiliary combustion gas, producing hot auxiliary combustion gas. This hot auxiliary combustion gas is both mixed and burned with pulverized solid fuel such as pulverized coal as the main fuel within the main combustion chamber defined at the front end portion of the burner, producing a stable flame having a temperature of about 2,000° to 2,400° C. It is possible to preheat the pulverized solid fuel to make the flame even more stable if the main combustion chamber is spaced from the auxiliary combustion heater at an adequate distance.

As has been described, the burner according to the present invention has an auxiliary combustion gas heater, and uses pulverized coal as its main fuel. The effects of the invention are that a stable flame due to combustion of pulverized solid fuel, the flame having a temperature of 2,000° to 2,400° C., can be produced, and that energy cost is reduced and the size miniaturized, in contrast to combustion burners using gaseous or liquid fuel mixed with pulverized solid fuel.

BRIEF DESCRIPTION OF THE DRAWINGS

In the drawings:

FIGS. 3 to 8 show a hot oxygen lance according to another aspect of the present invention, wherein FIG. 3 is an axial-sectional view of embodiment 2, FIG. 4 is an enlarged axial-sectional view of an oxygen heater in FIG. 3, FIG. 5 is an axial-sectional view of embodiment 3, FIG. 6 is an axial-sectional view of embodiment 4, FIG. 7 is an enlarged sectional view of an oxygen heater in FIG. 6, and FIG. 8 is a view taken along the line VI—VI in FIG. 7.

BEST MODE FOR CARRYING OUT THE INVENTION

Embodiment 1

Figure 1:
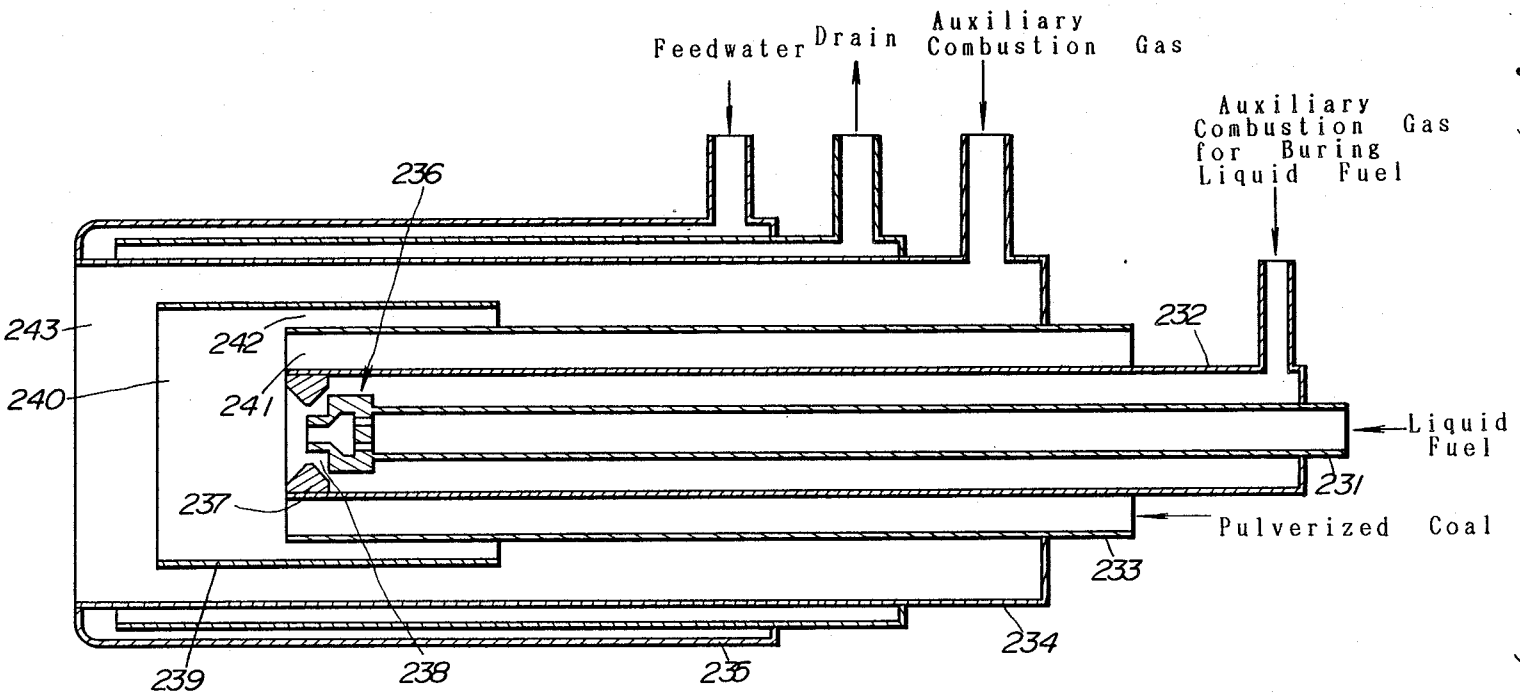
FIG. 1 (PRIOR ART)
FIG. 1 is an axial-sectional view of a conventional combination burner which uses pulverized coal mixed with liquid fuel.
Figure 2:
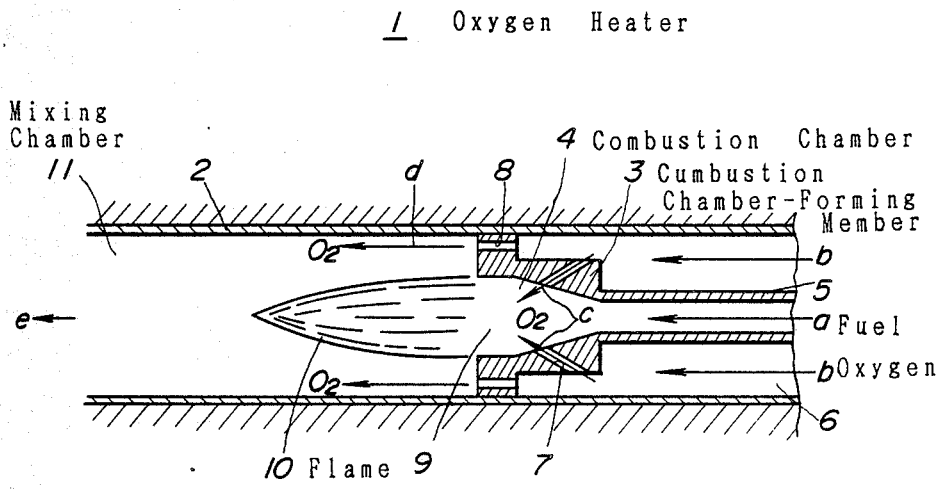
FIG. 2 is an axial-sectional view of embodiment 1 according to one aspect of the present invention.

FIG. 2 shows an oxygen heater according to the first aspect of the present invention. In FIG. 2, reference numeral 1 designates the oxygen heater, and reference numeral 2 denotes an inner wall which forms the oxygen heater 1. This inner wall is made of such material as fireproofing material and metal. Reference numeral 3 designates a combustion chamber-defining member, 4 designates a combustion chamber, 5 designates a fuel-supplying conduit, 6 denotes an oxygen-supplying passage, 7 denotes a nozzle for auxiliary combustion oxygen, 8 denotes an outlet for curtain oxygen, 9 designates an opening of the combustion chamber, 10 designates a flame and 11 denotes a chamber for mixing combustion gas with curtain oxygen.

Also, reference letter a designates fuel, b designates oxygen, c denotes auxiliary combustion oxygen, d denotes curtain oxygen and e denotes a flow of hot oxygen containing combustion gas.

In this oxygen heater, the fuel-supplying conduit 5 is supplied with the liquid or gaseous fuel a, while the oxygen-supplying passage 6 is supplied with oxygen b. A part of the oxygen b is introduced into the combustion chamber 4 through the nozzles 7 which are formed in the chamber-defining member 3 to communicate with both the combustion chamber 4 and the passage 6. The oxygen b is then mixed with the fuel a which has also been introduced into the chamber 4 and the mixture of the fuel a and the oxygen b is burned. The burning mixture is then jetted out of the opening 9 and produces the flame 10. In the mixing process, the fuel and the oxygen are mixed extremely well and produce a stable flame since the nozzles 7 are oriented to direct the oxygen passing through the nozzles 7 in a path converging on the opening 9 and the center axis of the combustion chamber 4.

The other part of the oxygen gas (i.e., most of the oxygen gas) b is jetted out of the outlets 8, and forms the oxygen curtain d surrounding the flame 10. This oxygen curtain absorbs the radiant heat generated by the flame and hinders the heat by convection and conduction from being transferred to the inner wall 2, whereby the oxygen curtain prevents the inner wall 2 from being damaged. The curtain oxygen and the combustion gas produced by the flame 10 are mixed within the mixing chamber 11, resulting in the production of initial hot oxygen containing combustion gas having a levelled temperature distribution, which forms the hot gas flow e and is supplied to the place where it is demanded. As previously described, since the heater has a mixing chamber and there are produced in the heater a flame for heating oxygen and an oxygen flow to be heated, it is possible, by using this oxygen heater, to reduce the heat loss and thus to efficiently produce hot oxygen. Also for the same reason, the oxygen heater can be miniaturized.

Embodiment 2

Figure 3:
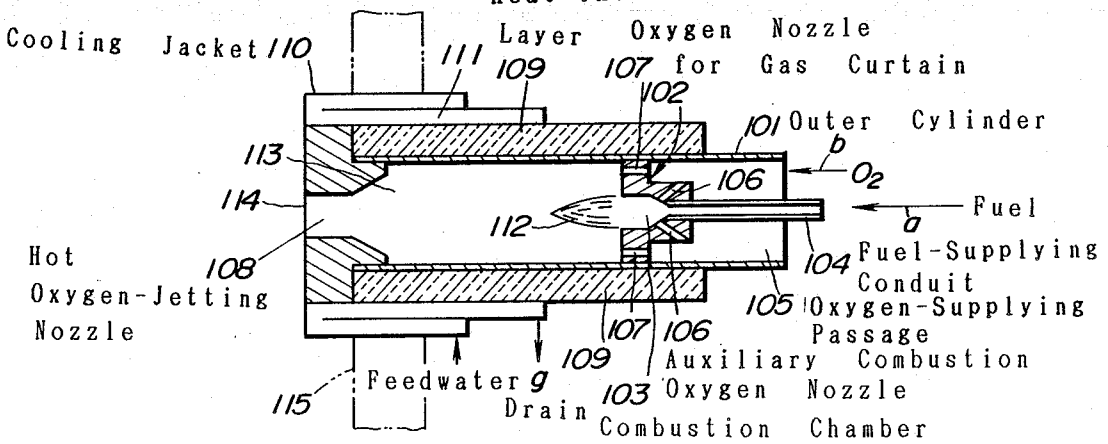
Figure 4:
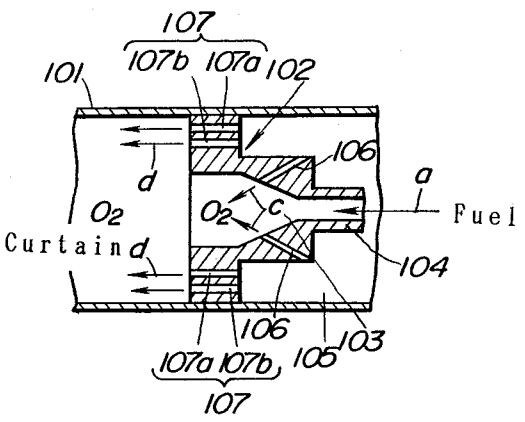

FIG. 3 shows a hot oxygen lance according to the second aspect of the present invention. In FIG. 3, reference numeral 101 designates an outer cylinder, and reference numeral 102 designates an oxygen heater disposed within the the outer cylinder 101. An enlarged axial-sectional view of the oxygen heater is shown in FIG. 4. Reference numeral 103 denotes a combustion chamber, 104 denotes a fuel-supplying conduit, 105 denotes an oxygen-supplying passage, 106 denotes nozzles for auxiliary combustion oxygen, 107 denotes nozzles for curtain oxygen, **107*a* denotes nozzles for outer curtain oxygen in the case that two oxygen curtains should be produced, and 107*b* denotes nozzles for inner curtain oxygen. Reference numeral 108 designates a hot oxygen gas-jetting nozzle, 109 designates a heat-insulating layer, 110 designates a jacket for cooling water, 111 designates a partition inside the jacket 110, 112 designates a flame, 113 designates a mixing chamber for mixing combustion gas and curtain oxygen, 114 designates a front end opening of the lance, and 115 designates a furnace wall. Also, in FIGS. 3 and 4**, arrow a means fuel flow, arrow b means oxygen flow, arrow c means flow of auxiliary combustion oxygen, arrow d means curtain oxygen flow, arrow e means hot oxygen containing combustion gas flow, arrow f means feedwater flow and arrow g means drain flow.

The device illustrated in FIGS. 3 and 4 merely serves as a hot oxygen lance. This oxygen lance is provided at the center of the outer cylinder 101 and behind the front end opening 114, with the oxygen heater 102 which has the combustion chamber 103 and the nozzles 107. The combustion chamber 103 is provided for mixing the fuel with the oxygen and for burning the mixture. The nozzles 107 surround the combustion chamber 103 to direct the oxygen flow passing therethrough to form an oxygen curtain. The heat-insulating layer 109 is disposed around the outer cylinder 101, and the water jacket 110 is fitted around the nozzle 108 and the front portion of the heat-insulating layer 109. Although, in FIG. 3, the heat-insulating layer 109 covers that portion of the outer cylinder's outer face from the front end nearly to the periphery of oxygen heater 102, it may cover only a portion of the outer cylinder from the position formed flame 112 to the mixing chamber 113. Although the jacket 110 fits around that portion of the lance which is to be disposed inside the furnace so that the lance is prevented from being damaged, it may fit around the entire lance. The jacket 110 shown in FIG. 3 is not the cooling means for the outer cylinder 101, therefore it will be required to dispose a water cooling jacket 110 arround the outer cylinder 101 instead of the heat-insulating layer 109 in order to protect the outer cylinder 101 from the heat of the hot oxygen gas when the temperature of the hot oxygen gas exceeds 1,200° C.

Both the curtain oxygen nozzles 107 and the auxiliary combustion oxygen nozzles 106 are supplied with oxygen through one passage, that is, the oxygen-supplying passage 105. The ratio between the amount of the auxiliary combustion oxygen and curtain oxygen depends on pressure resistance of the auxiliary oxygen nozzle 106. Naturally, there may be arranged two passages for supplying oxygen respectively to the nozzles 106 and 107. Those oxygen may be supplied by two branched passages before it was introduced into outer cylinder 101 of the lance, and this arrangement is not preferred since it causes complications in the construction of the lance.

In this oxygen lance, the fuel-supplying conduit 104 is supplied with gaseous or liquid fuel a, and the oxygen-supplying passage 105 is supplied with oxygen gas b. A part of the oxygen gas b (i.e., arrow c) is introduced into the combustion chamber 103 through the auxiliary combustion oxygen nozzles 106 and is mixed with the fuel a. This mixture of the fuel a and the oxygen b is then burned and produces the flame 112. When the fuel a is propane, the maximum temperature of the flame 112 is approximately 2,700° C. On the other hand, the remainder of the oxygen b is introduced into the curtain oxygen nozzles 107 and, as shown by arrow d, is jetted out of the nozzles 107, forming a oxygen curtain between the outer cylinder 101 and the flame 112. This oxygen curtain reduces the heat transfer to the outer cylinder 101 to the smallest possible degree. Next, within the mixing chamber 113, the curtain oxygen is mixed with the hot combustion gas generated due to the flame 112, resulting in the production of the hot oxygen containing combustion gas. This hot oxygen containing combustion gas is then, as shown by arrow e, discharged in a jet from the opening 114 of the nozzle 108 into the furnace.

An oxygen heating test was carried out, in which the oxygen lance previously described was used with 0.30 $Nm^3/h$ of fuel propane, 1.5 $Nm^3/h$ of auxiliary combustion oxygen and 25 $Nm^3/h$ of curtain oxygen. As a result, there was produced a hot oxygen containing combustion gas. The temperature and the oxygen content of the hot oxygen containing combustion gas are shown in Table 1.

TABLE 1

| | |
|---|---|
| Curtain Oxygen ($Nm^3/h$) | 25 |
| Fuel $C_3H_8$ ($Nm^3/h$) | 0.30 |
| Auxiliary Combustion Oxygen ($Nm^3/h$) | 1.5 |
| Oxygen Content of the Hot Gas (%) | 92.3 |
| Temperature of the Hot Gas (°C.) | 800 |

Embodiment 3

Figure 5:
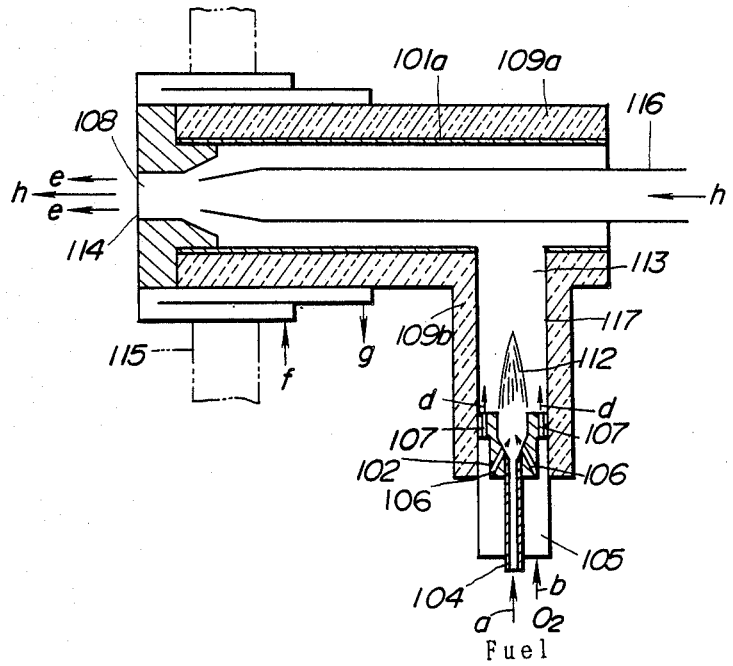

FIG. 5 shows another hot oxygen lance according to the second aspect of the present invention. In this lance, there are disposed not only a branch cylinder for supplying hot oxygen gas but also a center pipe coaxially within the outer cylinder in order to supply a furnace with pulverized material for refining such as, cokes, pulverized coal and iron ore. This center pipe may be a pipe for observing the inside of the furnace instead of being the pulverized material-supplying pipe. Because the center pipe takes up the center position of the outer cylinder 101*a*, the outer cylinder 101*a* is provided with a branch cylinder in which the oxygen heater 102 is disposed. Although the branch cylinder 117 in FIG. 5 is connected perpendicularly to the outer cylinder 101*a*, the angle between the outer cylinder and the branch cylinder may be set at random.

In FIG. 5, like reference characters as in FIG. 2 designate corresponding parts, and descriptions of the corresponding parts are omitted. The reference numeral 101*a* denotes the main outer cylinder, 116 denotes the center pipe, 117 denotes the branch cylinder, 109*a* denotes a heat-insulating layer for the main outer cylinder, 109*b* denotes a heat-insulating layer for the branch cylinder, and reference letter h denotes a flow of the pulverized material for refining.

The functions of the branch pipe 117 and the oxygen heater 102 are the same as that of the oxygen heater of embodiment 2. The pulverized material for refining is introduced into the center pipe 116 by a carrier gas such as carbon monoxide and argon, and is jetted from the nozzle 108 into the furnace together with hot oxygen containing combustion gas.

Embodiment 4

Figure 6:
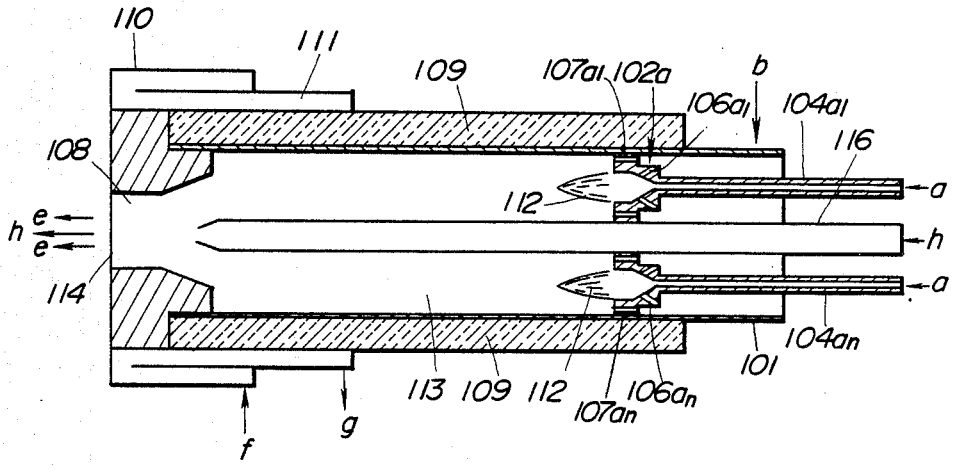

FIG. 6 illustrates still another oxygen lance according to the second aspect of the present invention. This lance is also used for supplying hot oxygen and has a center pipe at the center of the lance. The center pipe is also used either as a pipe for supplying the pulverized material or as a pipe for observing the inside of the furnace. In the lance of embodiment 3, the existence of the branch cylinder causes the entire construction of the lance to be complicated, whereby there arises inconveniences such as difficulty in manufacturing the lance and difficulty in operating the lance. In contrast, the lance of this embodiment has both an oxygen heater 102*a* and a center pipe 116 which is coaxially disposed in the outer cylinder 101. The oxygen heater 102*a* has a plurality of combustion chambers defined around the center pipe 116. The heater 102*a* is provided with a plurality of oxygen nozzles consisting of small holes or slits, for directing oxygen passing through the nozzles to form an oxygen curtain enclosing the combustion chambers.

Figure 7:
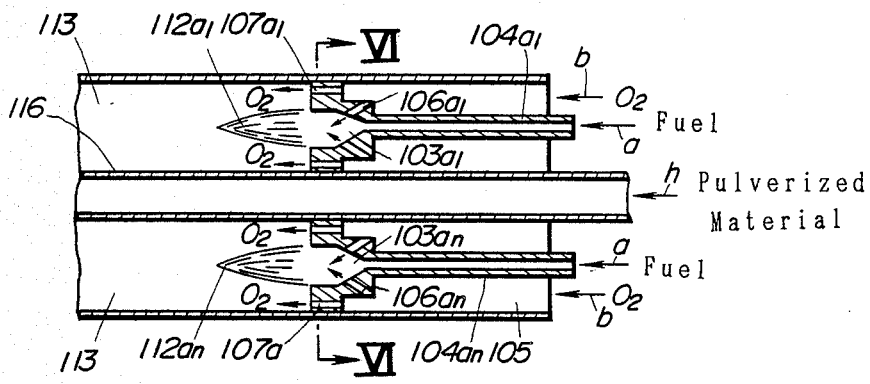
Figure 8:
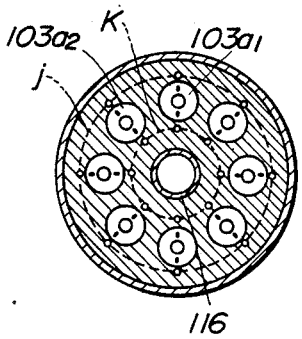

FIG. 7 is an enlarged axial-sectional view of the oxygen heater 102*a*. FIG. 8 is a view taken along the line VI—VI in FIG. 7. In these drawings, like reference characters as in embodiments 2 and 3 designate corresponding parts, and descriptions of the corresponding parts are omitted. Reference numerals 103$a_l$ to 103$a_n$ designate the combustion chambers, 104$a_l$ to 104$a_n$ designate conduits for supplying the combustion chambers with fuel, 106$a_l$ to 106$a_n$ designate oxygen nozzles for introducing the auxiliary combustion oxygen into the combustion chambers, and 107$a_l$ to 107$a_n$ denote oxygen curtain nozzles for directing oxygen passing therethrough to form the oxygen curtain enclosing the combustion chambers. In the same manner as embodiment 2, other oxygen nozzles forming another annular row of nozzles may be provided around the annular row of the nozzles 107$a_l$ to 107$a_n$. Reference numerals 112$a_l$ to 112$a_n$ designate flames produced in the combustion chambers. Reference letter j designates an oxygen curtain formed between the outer cylinder 101 and the combustion chambers 103$a_l$ to 103$a_n$ by the oxygen jetted out of the curtain nozzles 107$a_l$ to 107$a_n$, and reference letter k also designates an oxygen curtain formed between the center pipe 116 and the combustion chambers 103$a_l$ to 103$a_n$.

The fuel for the lance may be carried to the lance by a single passage which extends to the entrance of the outer cylinder 101 to connect with the fuel-supplying conduits 104$a_l$ to 104$a_n$. Otherwise, the single passage extends into the outer cylinder 101 reaching in the vicinity of the oxygen heater 102*a*. The former single passage makes the construction of the entire lance more complicated.

The oxygen may be introduced into the outer cylinder by means of a conduit and is distributed into the auxiliary combustion oxygen and the curtain oxygen. The ratio between the amount of the auxiliary combustion oxygen and the amount of the curtain oxygen depends on the pressure resistance of both the nozzles 106$a_l$ to 106$a_n$ and the nozzles 107$a_l$ to 107$a_n$. Each of the combustion chambers may have its own oxygen-supplying conduit connected to the corresponding combustion chamber. However, such oxygen-supplying conduits are not preferred since they cause the construction of the lance to be complicated.

The functions of the lance having the oxygen heater of this embodiment are the same as that of the lance of embodiment 2. One additional function of the lance of this embodiment is that the oxygen curtain k is formed between the center pipe 116 and the combustion chambers 103$a_l$ to 103$a_n$ as well as the oxygen curtain j between the outer cylinder 101 and the combustion chambers. The oxygen curtain k prevents the center pipe 116 from being overheated.

Also, the lance of this embodiment has the merit that it is easier to manufacture and to handle in comparison with the hot oxygen lance of embodiment 3.

Table 2 shows the temperature and the oxygen content of a produced hot oxygen containing combustion gas when the lance of this embodiment has eight combustion chambers and is supplied with 0.35 $Nm^3/h$ of fuel propane, 1.75 $Nm^3/h$ of auxiliary combustion oxygen and 25 $Nm^3/h$ of curtain oxygen.

TABLE 2

| | |
|---|---|
| Curtain Oxygen ($Nm^3/h$) | 25 |
| Fuel $C_3H_8$ ($Nm^3/h$) | 0.35 |
| Auxiliary Combustion Oxygen ($Nm^3/h$) | 1.75 |
| Oxygen Content of the Hot Gas (%) | 91.1 |
| Temperature of the Hot Gas (°C.) | 800 |

Embodiment 5

Figure 9:
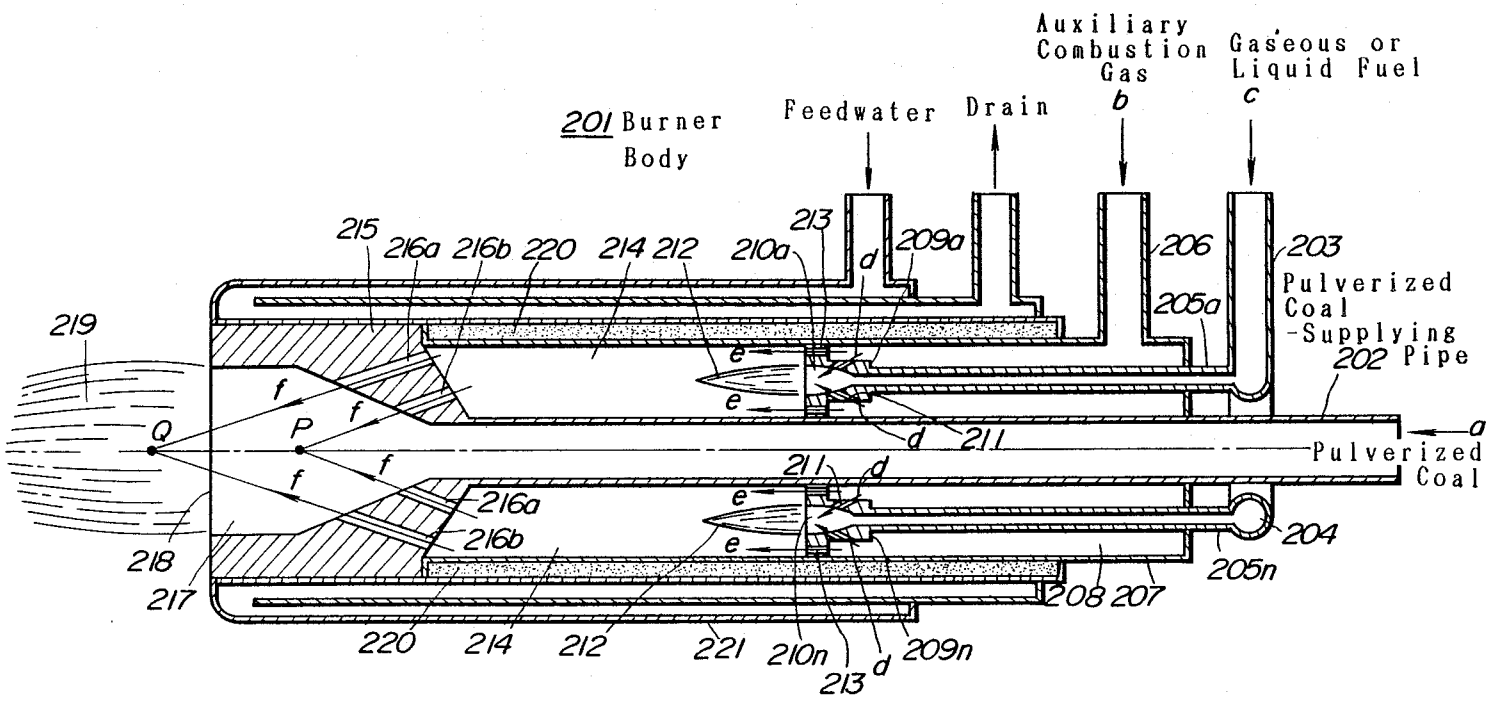
FIG. 9 is an axial-sectional view of a pulverized coal burner of embodiment 5 according to still another aspect of the present invention.

FIG. 9 illustrates a pulverized coal burner according to the third aspect of the present invention. In this drawing, reference numeral 201 denotes a burner body. 202 designates a pulverized coal-supplying pipe. 203 denotes a conduit for supplying gaseous or liquid fuel for the preheating of auxiliary combustion gas. 204 designates a branch pipe for supplying gaseous or liquid fuel. Reference numerals 205*a* to 205*n* denote pipes for supplying gaseous or liquid fuel for the preheating of auxiliary combustion gas. Reference numeral 206 designates an auxiliary combustion gas-supplying conduit. 207 designates an auxiliary combustion gas supplying pipe. 208 denotes a passage defined by the pipes 202 and 207 which are coaxial to each other. Reference numerals 209*a* to 209*n* denote a plurality of auxiliary combustion gas heaters circumferentially disposed around the pulverized coal-supplying pipe 202. 210*a* to 210*n* denote combustion chambers (the sub-combustion chamber) formed in the auxiliary combustion gas heaters. Reference numeral 211 denotes an auxiliary combustion gas nozzle for jetting auxiliary combustion gas into the combustion chambers 210*a* to 210*n*. 212 denotes a flame for preheating auxiliary combustion gas. 213 denotes a curtain nozzle for jetting auxiliary combustion gas so that the flow of auxiliary combustion gas forms a auxiliary combustion gas curtain enclosing the combustion chambers 210*a* to 210*n*. 214 denotes a mixing chamber for mixing hot combustion gas with auxiliary combustion gas having room temperature. 215 denotes a member forming a pulverized coal combustion nozzle. Reference numerals 216*a* and 216*b* denote nozzles for jetting hot auxiliary combustion gas. 217 denotes a main combustion chamber. 218 denotes a flame-throwing opening. 219 denotes a flame due to the combustion of pulverized coal. The hot auxiliary combustion gas-jetting nozzles 216*a* and 216*b* consist of a plurality of small holes or slits oriented to direct the auxiliary combustion gas passing therethrough in a path converging on points P and Q which are positioned on the center axis of the burner body 201 and in the vicinity of the opening 218. Naturally, other annular rows (3 or 4 rows) of the auxiliary combustion gas-jetting nozzles other than the nozzles 216*a* and 216*b*, may be formed in the nozzle-forming member 215.

Reference numeral 220 designates a heat-insulating layer disposed on the entire outer surface of auxiliary combustion-supplying pipe 207. This heat-insulating layer hinders heat generated by the auxiliary combustion gas heater 209*a* to 209*n* from being convectively transferred radially outward.

Reference numeral 221 designates a cooling jacket for circulating cooling water therein. This jacket 221 is provided to prevent the front end portion of the burner, that is, mainly the forming member 215, from being damaged by the radiation heat radiated from the flame 219 and the furnace.

Reference letter a denotes pulverized coal, b denotes auxiliary combustion gas which may be comprised oxygen, oxygen-enriched air, or air, c denotes gaseous or liquid fuel, d denotes auxiliary combustion gas used for burning the fuel and preheating the curtain gas, e denotes auxiliary combustion gas used for forming the gas curtain, and f denotes a flow of hot auxiliary combustion gas.

In the aforementioned burner, pulverized coal, that is, the main fuel is introduced into the pulverized coal supplying pipe 202 together with a carrier gas such as monoxide carbon and argon. On the other hand, the gaseous or liquid fuel for preheating the auxiliary combustion gas is introduced into the gaseous or liquid fuel-supplying conduit 203, and is supplied into the gaseous or liquid fuel-supplying pipes 205*a* to 205*n* through the branch pipe 204. The gaseous or liquid fuel, then, reaches the auxiliary combustion gas heaters 209*a* to 209*n* and is introduced into the combustion chambers 210*a* to 210*n*. The auxiliary combustion gas is introduced into the auxiliary combustion gas-supplying conduit 206, and reaches the auxiliary combustion gas heaters 209*a* to 209*n* via the auxiliary combustion gas supplying passage 208. A part of the auxiliary combustion gas is, then, introduced into the combustion chambers 210*a* to 210*n* through the auxiliary combustion gas nozzle 211. Subsequently, the auxiliary combustion gas introduced into the combustion chambers 210*a* to 210*n* is mixed with the gaseous or liquid fuel which has been introduced into the combustion chambers 210*a* to 210*n*. The mixture of the fuel and the auxiliary combustion gas is then burned in the combustion chambers 210*a* to 210*n*, whereby the flame 212 for preheating the auxiliary combustion gas is produced. The other part of the auxiliary combustion gas passes through the curtain nozzles 213 and forms an auxiliary combustion gas curtain enclosing the combustion chambers 210*a* to 210*n*. The gas curtain protects the auxiliary combustion gas-supplying pipe 207 by hindering the heat from being convectively transferred from the preheating flame 212 to the gas supplying pipe 207. The gas curtain also minimizes the heat loss.

The preheating flames 212 formed in each combustion chamber 210*a* to 210*n* produces hot combustion gas. This hot combustion gas is mixed with the curtain gas within the mixing chamber 214, whereby hot auxiliary combustion gas is produced. Then, this hot auxiliary combustion gas is introduced into the nozzles 216*a* and 216*b*, and is jetted out of the nozzles 216*a* and 216*b* into the main combustion chamber 217. The pulverized coal, which is introduced into the supplying pipe 202 together with the carrier gas, is jetted into the main combustion chamber 217, and then, is mixed with the hot auxiliary combustion gas having been jetted into the chamber 217. Then, the mixture of the pulverized coal and the hot auxiliary combustion gas at the same time as it is being burned, is jetted out of the opening 218, whereby the flame 219 due to the combustion of the pulverized coal is produced. Since the auxiliary combustion gas introduced into the combustion chamber 217 is hot, the combustion in the chamber 217 continues in a stable manner, resulting in the production of a stable flame having a temperature of approximately 2,000° to 2,400° C.

Also, by setting the distance between the main combustion chamber 217 and the auxiliary combustion gas heaters 209*a* to 209*n* at an adequate distance, it is possible to preheat the pulverized coal in the supplying pipe 202 by convectively transferring heat from the hot auxiliary combustion gas to the pulverized coal via the pipe wall. This operation makes it easier for the burner to produce a more stable flame.

What is claimed is:

1. A hot oxygen lance comprising an outer cylinder, oxygen supply means for supplying oxygen to the inside of the outer cylinder, and an oxygen heater and a center pipe, both disposed within the outer cylinder, the center pipe serving as a pipe for supplying a pulverized material to the outer cylinder, the oxygen heater defining a plurality of combustion chambers communicating with the oxygen supply means and circumferencially disposed around the center pipe, for both mixing and burning fuel with oxygen supplied thereto, each of the combustion chambers having an opening for blowing a flame, the oxygen heater including:

fuel supply means for supplying fuel to said plurality of combustion chambers; and oxygen nozzles, surrounding the opening of each of said combustion chambers and communicating with the oxygen supply means, for allowing oxygen supplied thereto to flow out therefrom and to form oxygen curtains, each of the curtains surrounding a flame due to the combustion in the corresponding combustion chamber to protect both the outer cylinder and the center pipe from heat emitted by the flame.

2. A hot oxygen lance as recited in claim 1, wherein the oxygen nozzles are arranged so that a multilayer of oxygen curtains are formed.

3. A hot oxygen lance as recited in claim 2, wherein the oxygen nozzles are arranged so that an inner oxygen curtain formed by the oxygen flowing out from the oxygen nozzles is of a flow rate higher than the flow rate of the outer adjoined oxygen curtain.

4. A hot oxygen lance as recited in claim 1, wherein the fuel is selected from the group consisting of gaseous fuel and liquid fuel.

5. A hot oxygen lance comprising an outer cylinder, a heat-insulating layer and/or a cooling jacket disposed around a part of or all of the outer surface of the outer cylinder, oxygen supply means for supplying oxygen to the inside of the outer cylinder, and an oxygen heater and a center pipe, both disposed within the outer cylinder, the center pipe serving as a pipe for supplying a pulverized material to the outer cylinder, the oxygen heater defining a plurality of combustion chambers, communicating with the oxygen supply means and circumferentially disposed around the center pipe, for both mixing and burning fuel with oxygen supplied thereto, each of the combustion chambers having an opening for blowing a flame, the oxygen heater including:

fuel supply means for supplying fuel to said plurality of combustion chambers; and oxygen nozzles, surrounding the opening of each of the combustion chambers and communicating with the oxygen supply means, for allowing oxygen supplied thereto to flow out therefrom to form an oxygen curtain.

6. A hot oxygen lance as recited in claim 5, wherein the oxygen nozzles are arranged so that a multilayer of oxygen curtains are formed.

7. A hot oxygen lance as recited in claim 6, wherein the oxygen nozzles are arranged so that an inner oxygen curtain formed by the oxygen flowing out from the oxygen nozzles is of a flow rate higher than the flow rate of the outer adjoined oxygen curtain.

8. A hot oxygen lance as recited in claim 5, wherein the fuel is selected from the group consisting of gaseous fuel and liquid fuel.

9. In a pulverized solid fuel burner which includes:

a member defining a main combustion chamber for both mixing and burning a pulverized solid fuel with an auxiliary combustion gas;

a pulverized solid fuel-supplying pipe, communicating with the main combustion chamber for leading the pulverized solid fuel into the main combustion chamber; and and auxiliary combustion gas-supplying pipe coaxial with and disposed around the solid fuel-supplying pipe and communicating with the main combustion chamber, for leading the auxiliary combustion gas into the main combustion chamber, the improvement which comprises an auxiliary combustion gas heater disposed within the auxiliary combustion gas-supplying pipe, the heater defining a sub-combustion chamber, communicating with the auxiliary combustion gas-supplying pipe, for both mixing a burning gaseous or liquid fuel with auxiliary combustion gas supplied thereto, the sub-combustion chamber having an opening for blowing a flame, the heater including: fuel supply means for supplying fuel to the sub-combustion chamber; and an oxygen nozzle, disposed around the opening of the sub-combustion chamber and communicating with the auxiliary combustion gas-supplying pipe, for allowing auxiliary combustion gas, supplied thereto to flow out therefrom and to form a gas curtain, the gas curtain surrounding a flame due to the combustion in the sub-combustion chamber to protect both the solid fuel-supplying pipe and the auxiliary combustion gas-supplying pipe from heat emitted by the flame.

10. A pulverized solid fuel burner as recited in claim 9 wherein the auxiliary combustion gas comprises oxygen.

11. A pulverized solid fuel burner as recited in claim 9 wherein the auxiliary combustion gas comprises oxygen-enriched air.

12. A pulverized solid fuel burner as recited in claim 9 wherein the auxiliary combustion gas comprises air.

* * * * *